US007549458B2

(12) United States Patent
Kwak

(10) Patent No.: US 7,549,458 B2
(45) Date of Patent: Jun. 23, 2009

(54) AUTOMATIC MOVEMENT ASCENT DEVICE GEAR OF ROLL SCREEN

(76) Inventor: Jae-Suk Kwak, Daehwa Maeul3-danji 302-705, Daehwa-dong, Ilsan-gu, Goyang-si, Gyeonggi-do (KR) 411-764

( * ) Notice: Subject to any disclaimer, the term of this patent is extended or adjusted under 35 U.S.C. 154(b) by 0 days.

(21) Appl. No.: 11/915,759

(22) PCT Filed: Jun. 2, 2006

(86) PCT No.: PCT/KR2006/002132

§ 371 (c)(1),
(2), (4) Date: Nov. 28, 2007

(87) PCT Pub. No.: WO2007/091752

PCT Pub. Date: Aug. 16, 2007

(65) Prior Publication Data

US 2008/0190572 A1 Aug. 14, 2008

(30) Foreign Application Priority Data

Feb. 6, 2006 (KR) ..... 10-2006-0011073

(51) Int. Cl.
*A47H 1/00* (2006.01)

(52) U.S. Cl. ..... 160/319; 160/321; 160/323.1; 188/265

(58) Field of Classification Search ..... 160/321, 160/323.1, 296, 305, 308, 193, 313, 319; 188/67, 180, 189, 265
See application file for complete search history.

(56) References Cited

U.S. PATENT DOCUMENTS

| | | | | |
|---|---|---|---|---|
| 4,662,423 | A | 5/1987 | Ishii | |
| 5,029,629 | A * | 7/1991 | Cheng-Pei | 160/300 |
| 5,167,269 | A * | 12/1992 | Abo | 160/305 |
| 5,542,464 | A * | 8/1996 | Shiina | 160/296 |
| 5,566,741 | A * | 10/1996 | Ogawara et al. | 160/297 |
| 7,234,503 | B2 | 6/2007 | Kwak | |

FOREIGN PATENT DOCUMENTS

| | | |
|---|---|---|
| EP | 0628697 | 12/1994 |
| JP | 7-233684 | 9/1995 |
| KR | 20-1998-063301 | 11/1998 |

OTHER PUBLICATIONS

English language Abstract of JP 7-233684.

* cited by examiner

*Primary Examiner*—Katherine W Mitchell
*Assistant Examiner*—Jaime F Cardenas-Garcia
(74) *Attorney, Agent, or Firm*—Greenblum & Bernstein, P.L.C.

(57) ABSTRACT

An automatic winding device of a roll screen is disclosed. A screen is automatically rolled up when a user pulls a ball chain down and the screen is automatically stopped when the user just releases the ball chain, to thereby adjust a height of the screen simply and easily. A lower end of the screen is prevented from colliding with the winding device when the screen is rolled up, to thereby create a silent and comfortable indoor environment.

4 Claims, 13 Drawing Sheets

【Figure 1】 Prior Art
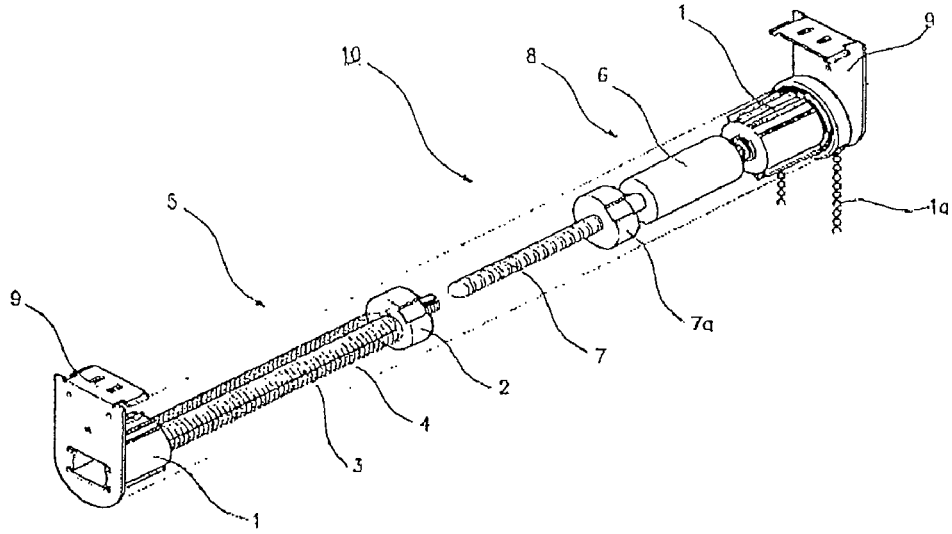

【Figure 2】
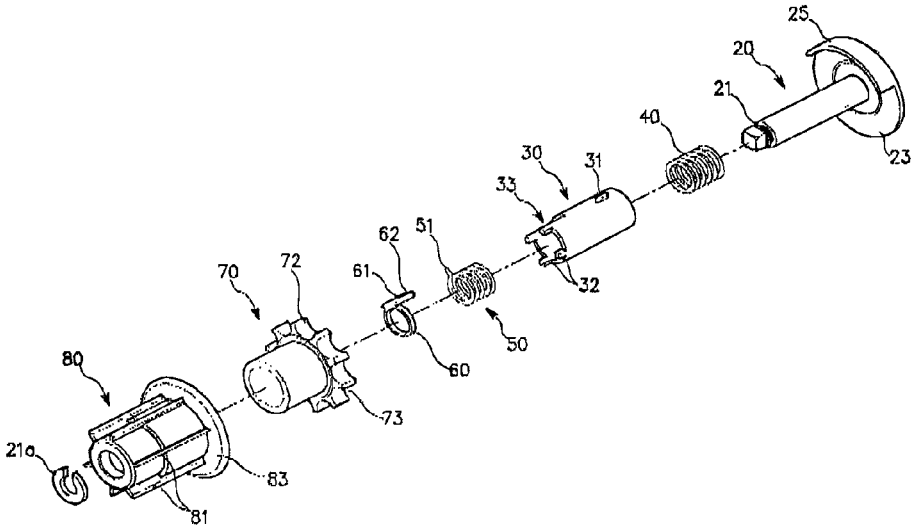

【Figure 3】
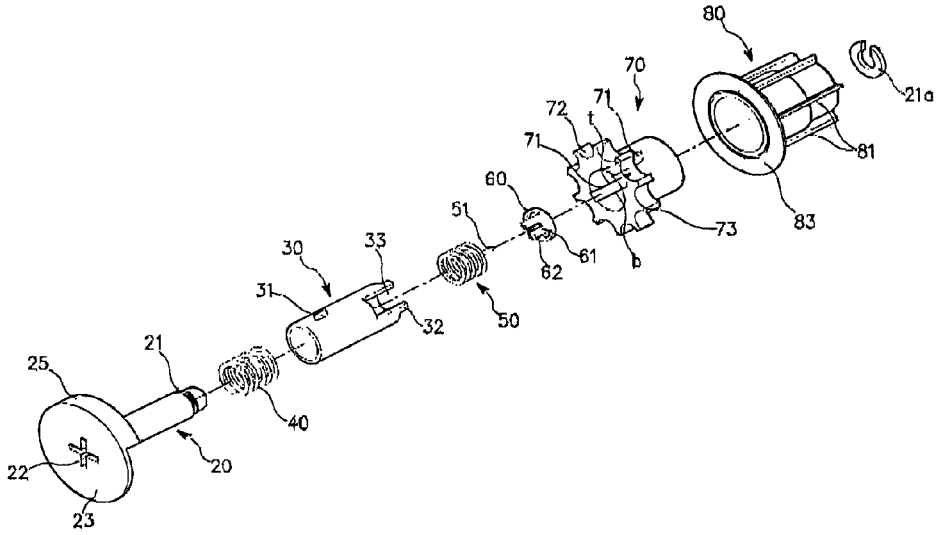

【Figure 4】
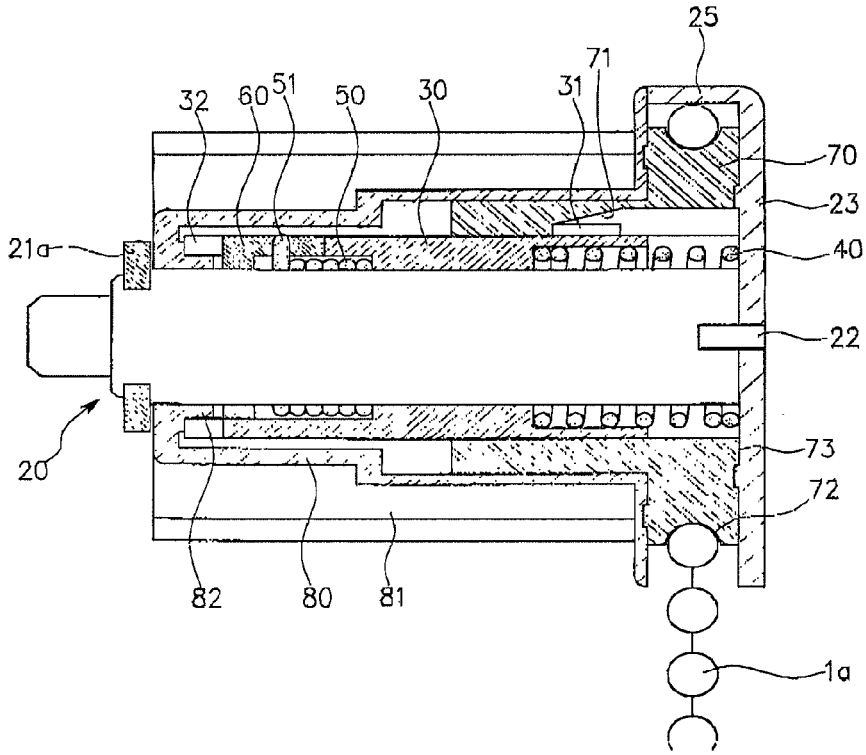

【Figure 5】
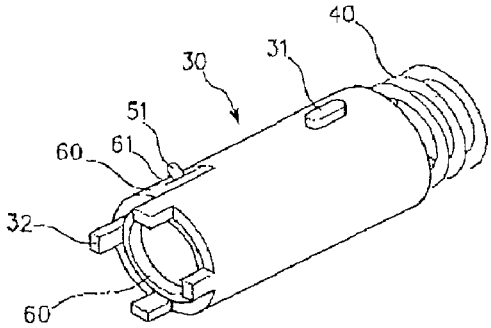
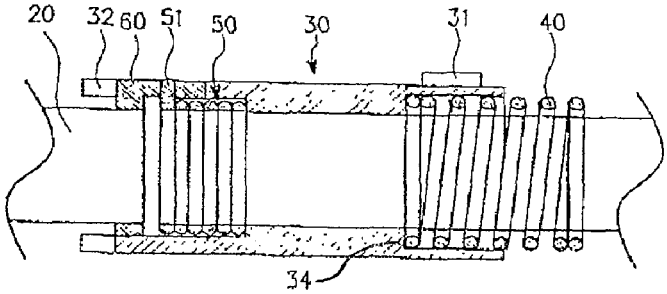

【Figure 6】
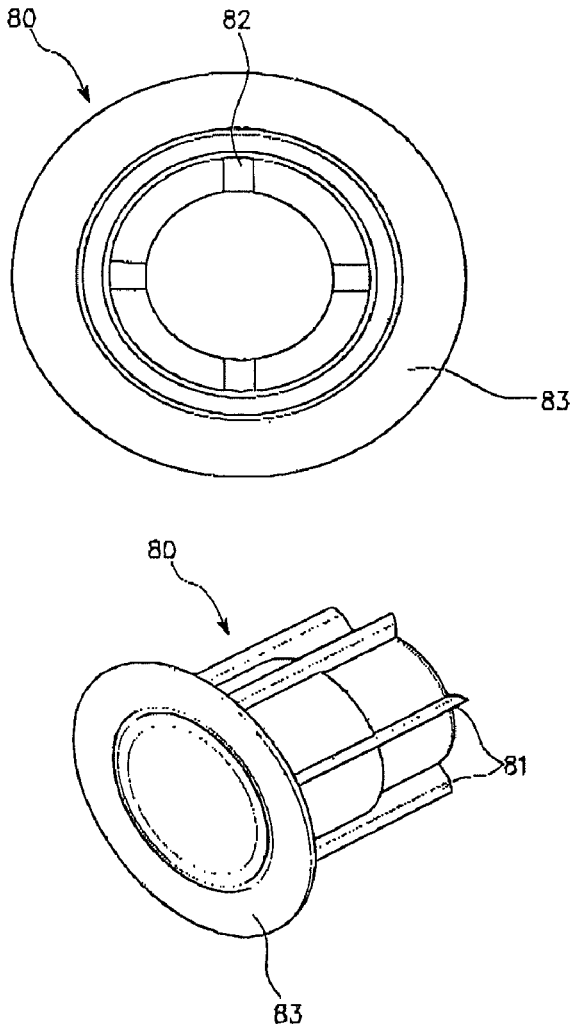

【Figure 7】
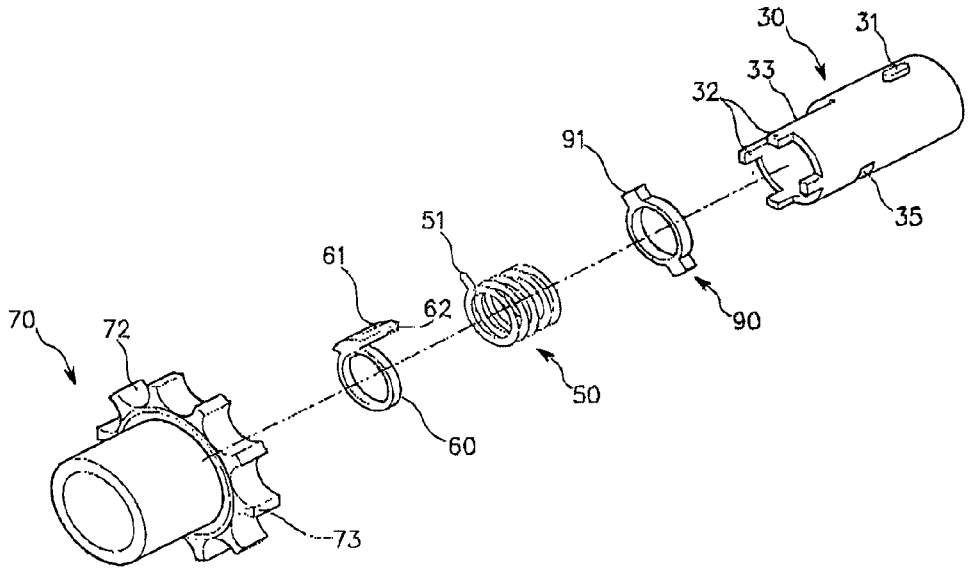

【Figure 8】
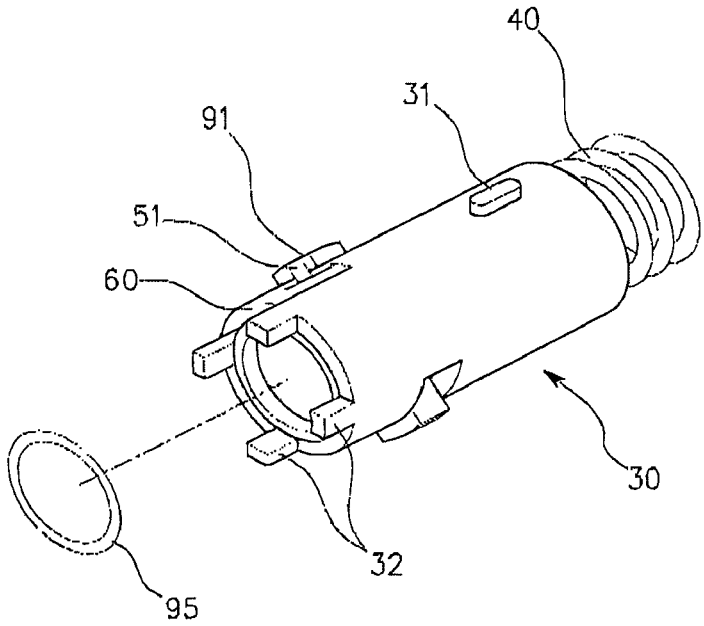
【Figure 9】
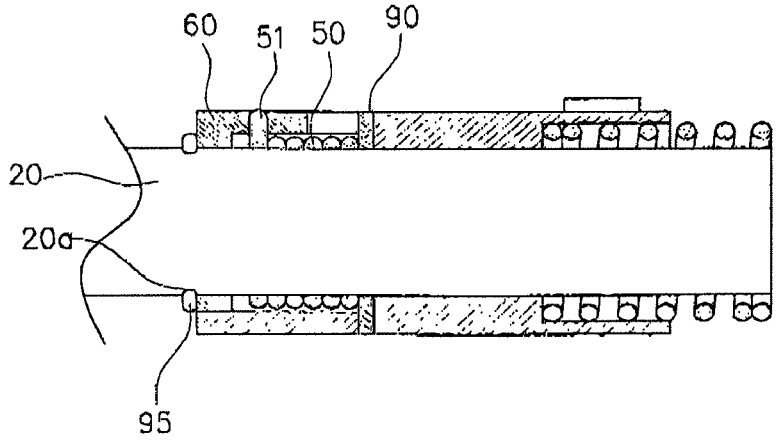

【Figure 10】
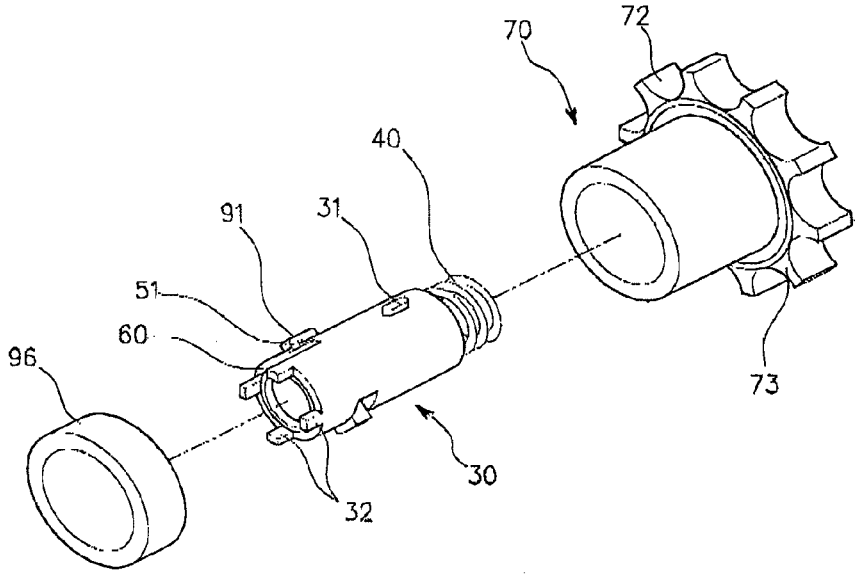
【Figure 11】
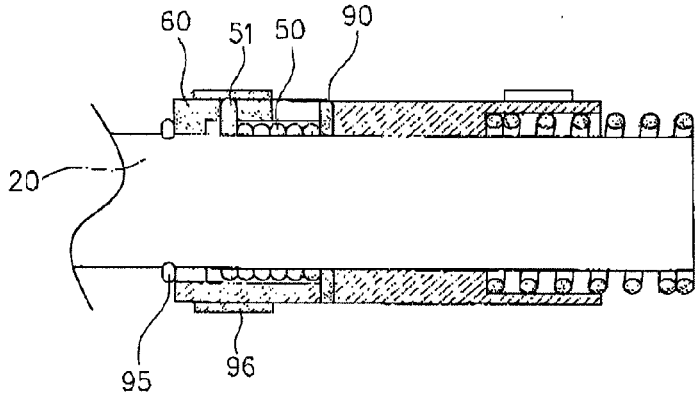

【Figure 12】
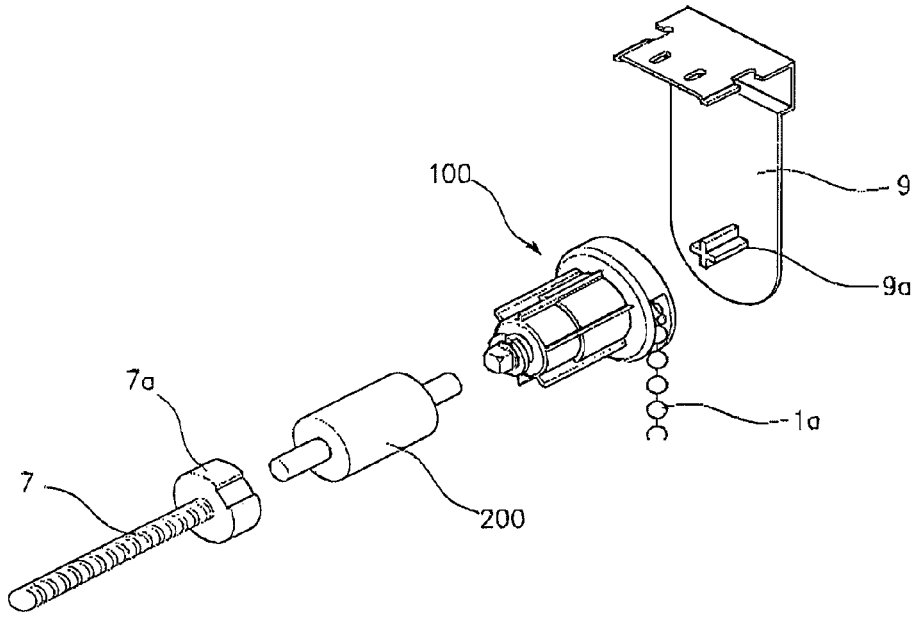

【Figure 13】
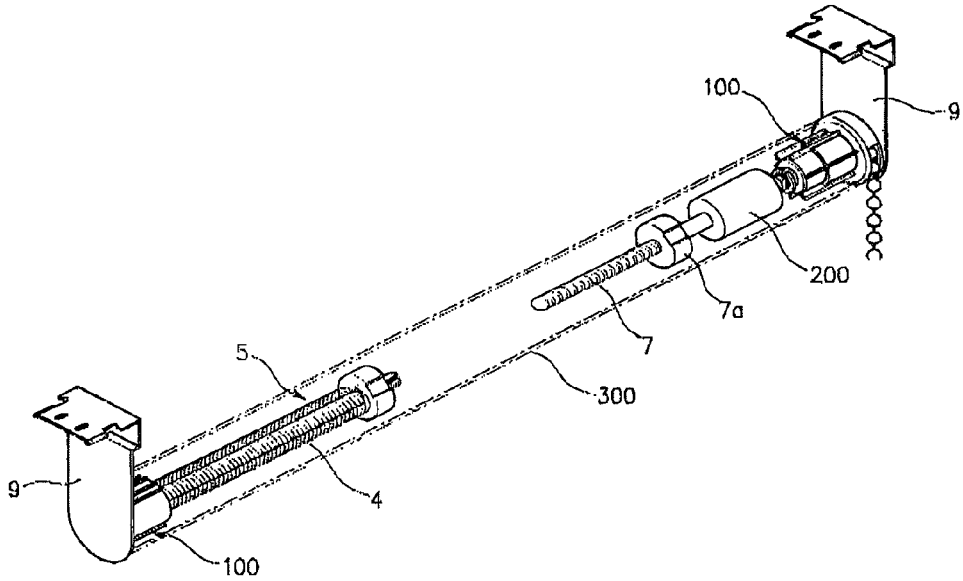

【Figure 14】
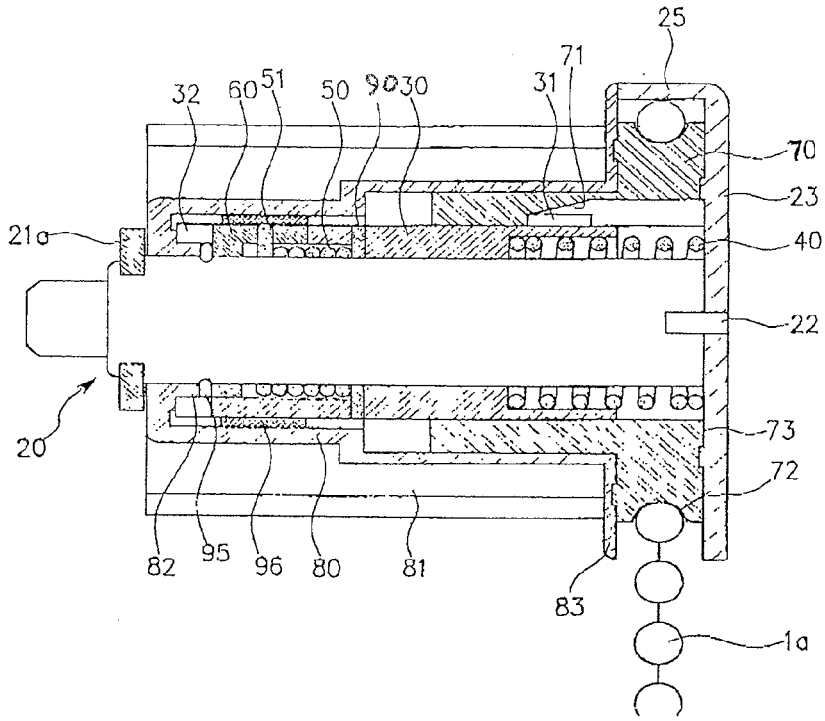

【Figure 15】
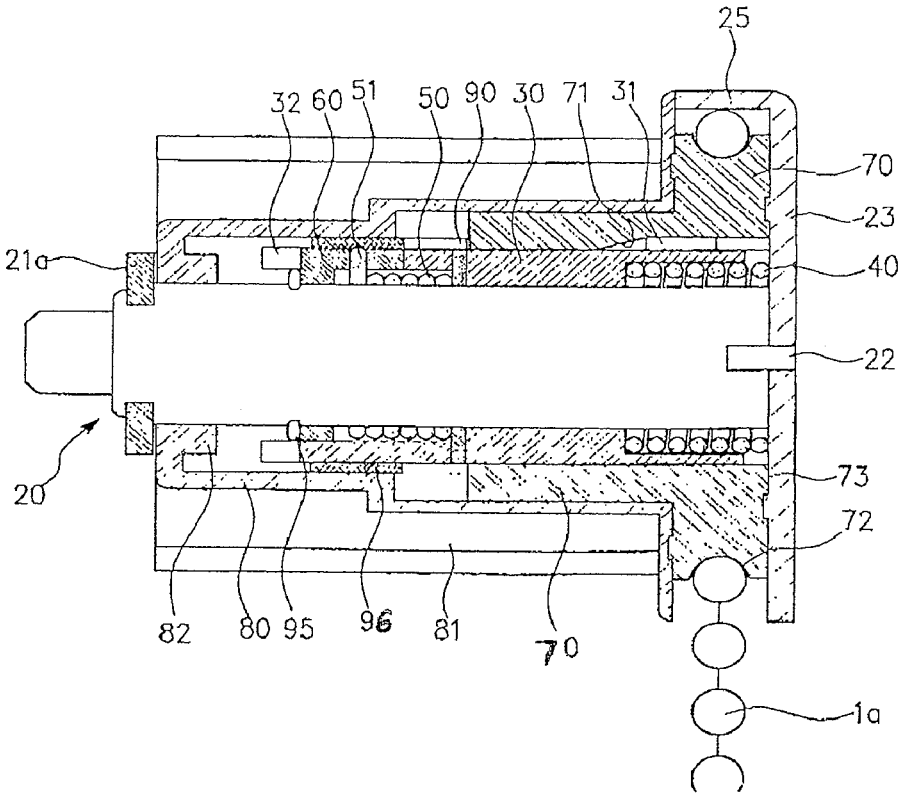

AUTOMATIC MOVEMENT ASCENT DEVICE GEAR OF ROLL SCREEN

TECHNICAL FIELD

The present invention relates to a roll screen, and more particularly to an automatic winding device of a roll screen capable of easily adjusting a height of a screen and preventing a lower end of the screen from colliding with the winding device and generating noise, to thereby create a silent indoor environment.

BACKGROUND ART

In general, a roll screen is used in home, an office, a restaurant or the like in place of a curtain. A screen is made from fabrics or synthetic resins. By pulling a ball chain coupled to a sprocket mounted to a bracket, the screen is released from a winding pipe and moves down by an elastic force of a spring. Then, the screen is stopped at a certain position for blocking sunlight through a window.

As shown in FIG. 1, a prior art roll screen 10 comprises two brackets 9 fixed to a window frame or a wall, and rotating means 5 and speed-reducing means 8 mounted to the brackets 9. A winding pipe, around which a screen is wound, is provided while surrounding the rotating means 5 and the speed-reducing means 8.

The rotating means 5 includes a rotating body 1, a connecting shaft 3 mounted to the rotating body 1, and a rotating piece 2 coupled to an end portion of the connecting shaft 3. A spring 4 is provided around the connecting shaft 3. One end of the spring 4 is supported by the rotating body 1, and the other end of the spring 4 is supported by the rotating piece 2. The rotating piece 2 moves left and right along the connecting shaft 3 by the elastic force of the spring 4.

The speed-reducing means 8 includes a rotating body 1 having an adjuster, a speed reducer 6 connected to the rotating body 1, a screw shaft 7 connected to the speed reducer 6, and a speed-reducing nut 7*a* coupled to the screw shaft 7.

By pulling a ball chain 1*a* coupled to a sprocket (not shown) mounted to the rotating body 1, the screen is rolled up to the uppermost position or adjusted to stop at a position to be desired. However, to adjust the height of the screen is troublesome because a user should pull the ball chain continuously.

To solve the above problem, an electromotive roll screen has been developed. However, since the prior art electromotive roll screen has a complicated structure, the installation, manipulation and maintenance thereof are difficult. Further, the prior art electromotive roll screen consists of relatively many components including electrical elements, which causes an increase of manufacturing costs.

DISCLOSURE OF INVENTION

Technical Problem

Therefore, the present invention has been made in view of the above problems, and it is an object of the present invention to provide an automatic winding device of a roll screen constructed so that a screen is automatically rolled up when a user pulls a ball chain down and the screen is automatically stopped when the user releases the ball chain, to thereby easily adjust a height of the screen with a small force.

It is another object of the present invention to provide an automatic winding device of a roll screen capable of simplifying a structure, to thereby facilitate manufacturing and installing processes and decrease manufacturing costs.

It is yet another object of the present invention to provide an automatic winding device of a roll screen capable of preventing a lower end of the screen from colliding with the winding device and generating noise, to thereby create a silent and comfortable indoor environment.

Technical Solution

In accordance with an aspect of the present invention, the above and other objects can be accomplished by the provision of an automatic winding device of a roll screen comprising: a fixing shaft formed with a washer recess at a front portion and a supporting plate at a rear portion, the supporting plate having a coupling recess; a feeding member mounted around the fixing shaft, the feeding member being formed with a coupling protrusion at an outer surface of a rear portion, teeth at a front end, and a guiding slot near the teeth; a first spring mounted inside the rear portion of the feeding member; a second spring mounted at a front of the fixing shaft, the second spring being formed with a connecting bar inserted in the guiding slot of the feeding member; a fixing ring mounted at the front of the fixing shaft, the fixing ring being formed with coupling pieces and a coupling slit provided between the coupling pieces into which the connecting bar of the second spring is inserted; a rotating member formed with slanted grooves at an inner surface in which the coupling protrusion of the feeding member is fitted and a sprocket having a plurality of ball recesses at an outer surface; and a housing mounted around the rotating member, the housing being formed with wings at an outer surface and teeth at an inner surface of a front portion.

Preferably, the device may further comprise a supplementary ring mounted at a front of the second spring, the supplementary ring being formed with fixing wings at upper and lower portions.

Preferably, the device may further comprise an O-ring mounted at a rear of the fixing ring to prevent the fixing ring from being pushed away.

Preferably, the device may further comprise an elastic cover provided to surround the guiding slot of the feeding member to prevent the coupling slit between the coupling pieces of the fixing ring from being widened.

Advantageous Effects

According to an automatic winding device of a roll screen in accordance with the present invention, a height of a screen can be adjusted simply and easily because the screen is automatically rolled up when a user pulls a ball chain down and the screen is automatically stopped when the user just releases the ball chain.

Further, a lower end of the screen is prevented from colliding with the winding device when the screen is rolled up, to thereby create a silent and comfortable indoor environment.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view showing a roll screen of a prior art;

FIGS. 2 and 3 are exploded perspective views showing an automatic winding device of a roll screen in accordance with a preferred embodiment of the present invention;

FIG. 4 is a cross-sectional view showing an automatic winding device of a roll screen in accordance with a preferred embodiment of the present invention;

FIG. 5 is a perspective view and a cross-sectional view showing a coupling state of a fixing ring;

FIG. 6 is a side view and a perspective view showing a cover;

FIG. 7 is an exploded perspective view showing a coupling state of a supplementary ring;

FIG. 8 is a perspective view showing an O-ring;

FIG. 9 is a cross-sectional view showing a coupling state of an O-ring;

FIG. 10 is a perspective view showing an elastic cover;

FIG. 11 is a cross-sectional view showing a coupling state of an elastic cover;

FIG. 12 is an exploded perspective view showing speed-reducing means;

FIG. 13 is a perspective view showing an overall structure of a roll screen equipped with an automatic winding device in accordance with a preferred embodiment of the present invention; and FIGS. 14 and 15 are cross-sectional views showing an operating state of an automatic winding device of a roll screen in accordance with a preferred embodiment of the present invention.

BEST MODE FOR CARRYING OUT THE INVENTION

Now, preferred embodiments of the present invention will be described in detail with reference to the annexed drawings.

FIGS. 2 and 3 are exploded perspective views showing an automatic winding device of a roll screen of the present invention, and FIG. 4 is a cross-sectional view showing an automatic winding device of a roll screen of the present invention. A reference numeral 100 in the drawings indicates a main body of an automatic winding device of a roll screen of the present invention.

An automatic winding device of a roll screen of the present invention comprises a fixing shaft 20, a feeding member 30, a first spring 40, a second spring 50, a fixing ring 60, a rotating member 70 and a housing 80.

The fixing shaft 20 is formed with a washer groove 21 at an outer surface of a front portion thereof, in which a washer 21*a* is fitted. A supporting plate 23 is formed at a rear end of the fixing shaft 20. An inserting recess 22 is formed at a rear surface of the supporting plate 23 to be mounted to the bracket 9 (see FIG. 1). The inserting recess 22 may be formed in a cross shape or in a rectangular shape.

The feeding member 30 is formed in a hollow cylindrical shape. A coupling protrusion 31 is formed at an outer surface of a rear portion of the feeding member 30. Multiple teeth 32 are formed radially at a front end of the feeding member 30. The teeth 32 extend axially. Preferably, the teeth 32 are provided by four, and arranged equiangularly. A guiding slot 33 is formed between two adjacent teeth 32.

The first spring 40 is located at a rear of the feeding member 30, and the second spring 50 is located at a front of the feeding member 30. The second spring 50 functions as a stopper, which will be described later. A connecting bar 51 is formed integrally at one end of the second spring 50.

A supporting seat 34 is formed at the inner surface of the feeding member 30, on which one end of the first spring 40 is seated. The first spring 40 is inserted into the rear portion of the feeding member 30, and then the feeding member 30 is mounted to the fixing shaft 20. The second spring 50 is inserted into the front portion of the feeding member 30. The connecting bar 51 of the second spring 50 is located in the guiding slot 33 of the feeding member 30.

The fixing ring 60 is located at a front of the second spring 50. A pair of coupling pieces 62 are formed at the fixing ring 60. The coupling pieces 62 extend toward the second spring 50. A coupling slit 61 is provided between the pair of coupling pieces 62, into which the connecting bar 51 of the second spring 50 is inserted.

The rotating member 70 is formed in a hollow cylindrical shape for accommodating the fixing shaft 20, the first spring 40, the feeding member 30, the second spring 50 and the fixing ring 60. Two slanted grooves 71 are formed symmetrically at an inner surface of the rotating member 70. A sprocket 73 having a plurality of ball recesses 72 is mounted around an outer surface of the rotating member 70. A ball chain 1*a* is coupled to the ball recesses 72 of the sprocket 73 in such a manner that balls of the ball chain 1*a* are received in the ball recesses 72.

A blocking plate 25 is formed around the upper semicircular periphery of the supporting plate 23. The blocking plate 25 extends toward the rotating member 70 so as to prevent the ball chain la from being separated from the ball recesses 72 of the sprocket 73.

The housing 80 for accommodating the rotating member 70 is formed with multiple wings 81 at an outer surface thereof. The wings 81 are arranged radially and extend axially.

As shown in FIG. 5, the fixing ring 60 is disposed at the front of the second spring 50. The connecting bar 51 of the second spring 50 is inserted into the coupling slit 61 provided between the coupling pieces 62 of the fixing ring 60. When a direction of a rotational force exerted to the fixing ring 60 is same as a winding direction of the second spring 50, the fixing ring 60 can rotate. However, when the rotational direction is opposite to the winding direction of the second spring 50, the fixing ring 60 is kept in a fixing state.

Referring again to FIG. 3, each slanted groove 71 is configured such that a lower side b is shorter than an upper side t. The surface of the groove 71 is slanted from the lower side b to the upper side t. The coupling protrusion 31 of the feeding member 30 is fitted in the slanted groove 71. By the rotational force of the rotating member 70, the coupling protrusion 31 moves along the slanted surface of the groove 71.

Two slanted grooves 71 may be formed symmetrically about the central axis of the rotating member 70. The coupling protrusion 31 of the feeding member 30 may be fitted in one of two grooves 71 selectively.

As shown in FIG. 6, multiple teeth 82 are formed radially at an inner surface of the housing 80. The teeth 82 extend toward the feeding member 30. Preferably, the teeth 82 are provided by four, and arranged equiangularly. When disposing the housing 80 around the rotating member 70, and the teeth 82 of the housing 80 are engaged with the teeth 32 of the feeding member 30. To fix the housing 80, the washer 21*a* is fitted in the washer groove 21 of the fixing shaft 20. A fixing plate 83 having a larger diameter is formed at the rear end of the housing 80. The fixing plate 83 contacts with the blocking plate 25 of the fixing shaft 20.

As shown in FIG. 7, a supplementary ring 90 is interposed between the feeding member 30 and the second spring 50. The supplementary ring 90 is formed with two opposite fixing wings 91*a* and 91*b* at upper and lower portions thereof.

The upper fixing wing 91*a* is positioned in the guiding slot 33 of the feeding member 30, and the lower fixing wing 91*b* is positioned in an inserting slit 35 which is formed at the feeding member 30 in a radial direction. This is for preventing the rotating member 70 from being pushed away by the elastic force of the first spring 40.

As shown in FIGS. 8 and 9, an O-ring 95 is put around the fixing shaft 20. The O-ring 95 is in close contact with the fixing ring 60 to prevent the fixing ring 60 from being pushed away from the second spring 50. A groove 20*a*, in which the O-ring 95 is fitted, is formed around the outer surface of the fixing shaft 20.

As shown in FIGS. 10 and 11, an elastic cover 96 having an annular cross-section is put around the feeding member 30. The elastic cover 96 surrounds the guiding slot 33 in which the coupling pieces 62 of the fixing ring 60 are inserted.

While the fixing ring 60 rotates together with the second spring 50 in the winding direction of the second spring 50, if the rotational force is exerted to the fixing ring 60 opposite to the winding direction of the second spring 50, the rotation of the second spring 50 is stopped and the repulsive force corresponding thereto widens the coupling slit 61 between two coupling pieces 62 of the fixing ring 60 into which the connecting bar 51 of the second spring 50 is inserted. However, the elastic cover 96 restricts the deformation of the coupling slit 61 and the coupling pieces 62, to thereby increase an operational stability.

As shown in FIGS. 12 and 13, the main body 100 constructed as above is fixed to the bracket 9 in such a manner that a coupling protrusion 9*a* of the bracket 9 is fitted into the inserting recess 22 of the fixing shaft 20.

A speed reducer 200 is connected to the front end of the fixing shaft 20. A screw shaft 7 is connected to the speed reducer 200. A speed-reducing nut 7*a* is screw-coupled to the screw shaft 7. As the speed-reducing nut 7*a* rotates along the screw shaft 7, the position of the screen is adjusted. When the screen rolls up, a top limited position of the screen may be predetermined to avoid a collision of the lower end of the screen with the winding device.

On the opposite side, another main body 100 is also fixed to the bracket 9, and a spring 4 of rotating means 5 is mounted to the main body 100. A hollow winding pipe 300, around which the screen is wound, is mounted to two opposite main bodies 100. The main bodies 100, the speed reducer 200, the speed-reducing nut 7*a*, the screw shaft 7 and the spring 4 are accommodated in the winding pipe 300.

Hereinafter, the operation of the present invention will be described with reference to FIGS. 14 and 15.

When a user pulls down the ball chain 1*a* coupled to the ball recesses 72 of the sprocket 73 or a knob (not shown) provided at the lower end of the screen, the rotating member 70 rotates in one direction while the fixing shaft 20 is in a fixing state.

Since the coupling protrusion 31 of the feeding member 30 is received in the slanted groove 71 of the rotating member 70 and the teeth 82 of the housing 80 are coupled to the teeth 32 of the feeding member 30, the feeding member 30 and the housing 80 also rotate together.

Since the coupling slit 61 of the fixing ring 60 is located in the guiding slot 33 of the feeding member 30 and the connecting bar 51 of the second spring 50 is inserted into the coupling slit 61, the second spring 50 also rotates. This is when the rotating direction is same as the winding direction of the second spring 50.

As described above, only the fixing shaft 20 is in a fixing state, but the feeding member 30, the rotating member 70 and the housing 80 rotate simultaneously. The spring 4 of the rotating means 5 mounted to the main body 100 is compressed and wound, and the speed-reducing nut 7*a* moves forward along the screw shaft 7. The winding pipe 300, which is in contact with the wings 81 of the housing 80, rotates to roll the screen down.

On the other hand, when rolling the screen up, the user maintains the state of pulling the ball chain 1*a* down. As shown in FIG. 15, the coupling protrusion 31 of the feeding member 30 moves back along the slanted groove 71 of the rotating member 70. The teeth 32 of the feeding member 30 are disengaged from the teeth 82 of the housing 80, so the housing 80 is released from the binding state.

Since the rotating direction of the feeding member 30 is opposite to the winding direction of the second spring 50, the second spring 50 is kept in a stationary state and the connecting bar 51 of the second spring 50 is kept to be inserted into the coupling slit 61 of the fixing ring 60.

As the feeding member 30 moves back, the feeding member 30 compresses the first spring 40. The elastic restoring force of the first spring 40 is exerted to the rotating member 70 to push the same forward. However, the fixing wings 91*a* and 91*b* of the supplementary ring 90 mounted to the feeding member 30 support the rotating member 70 to prevent the rotating member 70 from being pushed by the first spring 40. Also, the elastic cover 96 prevents the coupling slit 61 between two coupling pieces 62 of the fixing ring 60 from being widened.

As the housing 80 is released from the binding state and the spring 4 of the rotating means 5, which has been compressed, expands to its original shape, the housing 80 and the winding pipe 300 rotate in a reverse direction to roll the screen up.

The speed reducer 200 mounted at the front of the fixing shaft 20 adequately reduces the speed of the screen rising by the elastic restoring force of the spring 4. The speed-reducing nut 7*a* screw-coupled to the screw shaft 7 prevents the lower end of the screen from rolling up to the rolling device.

When stopping the rising screen at a certain position, the user releases the ball chain 1*a* which he/she has pulled down. The feeding member 30, which has moved back while compressing the first spring 40, moves forward by the elastic restoring force of the first spring 40.

The teeth 35 of the feeding member 30 are engaged again with the teeth 82 of the housing 80, and the coupling pieces 62 of the fixing ring 60 are inserted into the guiding slot 33 of the feeding member 30, to thereby stop the rotation of the housing 80.

A top limited position of the screen may be predetermined to avoid a collision of the lower end of the screen with the winding device, to thereby create a silent and comfortable indoor environment.

INDUSTRIAL APPLICABILITY

As apparent from the above description, the automatic winding device of a roll screen in accordance with the present invention is constructed so that a screen is automatically rolled up when a user pulls a ball chain down and the screen is automatically stopped when the user just releases the ball chain. Accordingly, a height of the screen can be adjusted simply and easily.

Further, a lower end of the screen is prevented from colliding with the winding device when the screen is rolled up, to thereby create a silent and comfortable indoor environment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An automatic winding device of a roll screen, comprising:

a fixing shaft formed with a washer recess at a front portion and a supporting plate at a rear portion, the supporting plate having a coupling recess;

a feeding member mounted around the fixing shaft, the feeding member being formed with a coupling protrusion at an outer surface of a rear portion, teeth at a front end, and a guiding slot near the teeth;

a first spring mounted inside the rear portion of the feeding member;

a second spring mounted at a front of the fixing shaft, the second spring being formed with a connecting bar inserted in the guiding slot of the feeding member;

a fixing ring mounted at the front of the fixing shaft, the fixing ring being formed with coupling pieces and a coupling slit provided between the coupling pieces into which the connecting bar of the second spring is inserted;

a rotating member formed with slanted grooves at an inner surface in which the coupling protrusion of the feeding member is fitted and a sprocket having a plurality of ball recesses at an outer surface; and a housing mounted around the rotating member, the housing being formed with wings at an outer surface and teeth at an inner surface of a front portion.

2. The device according to claim 1, further comprising:

a supplementary ring mounted at a front of the second spring, the supplementary ring being formed with fixing wings at upper and lower portions.

3. The device according to claim 1, further comprising:

an O-ring mounted at a rear of the fixing ring to prevent the fixing ring from being pushed away.

4. The device according to claim 1, further comprising:

an elastic cover provided to surround the guiding slot of the feeding member to prevent the coupling slit between the coupling pieces of the fixing ring from being widened.

* * * * *